US007418234B2

(12) United States Patent
Murakami et al.

(10) Patent No.: US 7,418,234 B2
(45) Date of Patent: Aug. 26, 2008

(54) IMAGE FORMING APPARATUS

(75) Inventors: Susumu Murakami, Kyoto (JP); Minoru Tomiyori, Kyoto (JP); Hideshi Izumi, Nara (JP); Takahisa Narikiyo, Nara (JP); Kuniaki Nakano, Kyoto (JP); Yoshie Iwakura, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 347 days.

(21) Appl. No.: 10/550,543

(22) PCT Filed: Apr. 9, 2004

(86) PCT No.: PCT/JP2004/005184

§ 371 (c)(1),
(2), (4) Date: Sep. 26, 2005

(87) PCT Pub. No.: WO2004/092847

PCT Pub. Date: Oct. 28, 2004

(65) Prior Publication Data

US 2006/0216090 A1 Sep. 28, 2006

(30) Foreign Application Priority Data

Apr. 11, 2003 (JP) ..... 2003-107940

(51) Int. Cl.
*G03G 15/00* (2006.01)

(52) U.S. Cl. ..... 399/401; 399/404; 271/225; 271/285; 271/286

(58) Field of Classification Search ..... 399/401, 399/404; 271/225, 285, 286
See application file for complete search history.

(56) References Cited

U.S. PATENT DOCUMENTS 5,162,857 A * 11/1992 Higeta et al. ..... 399/401
6,424,365 B1 * 7/2002 Kimoto ..... 347/129

FOREIGN PATENT DOCUMENTS

| | | | |
|---|---|---|---|
| JP | 2-18242 | A | 1/1990 |
| JP | 4-208949 | A | 7/1992 |
| JP | 2002-23576 | A | 1/2002 |
| JP | 2002-333748 | A | 11/2002 |

* cited by examiner

*Primary Examiner*—Ren Yan
*Assistant Examiner*—Andy L Pham
(74) *Attorney, Agent, or Firm*—Birch, Stewart, Kolasch & Birch, LLP

(57) ABSTRACT

A discharge unit is disposed downstream of a principal transport path of a compound machine, and a shifter function is provided in this discharge unit. By shifting the paper passage position relative to a photosensitive drum when printing the front side and the paper passage position relative to the photosensitive drum when printing the back side, the region in which the surface electric potential of the photosensitive drum increases is diminished, and the region in which photographic fog is generated is made smaller. Thus, when printing the second and subsequent sheets, even when a slight amount of displacement of the transport position of the recording paper occurs, it is possible to suppress that recording paper making contact in the photographic fog region on the photosensitive drum, and defective printing can be prevented.

14 Claims, 6 Drawing Sheets

IMAGE FORMING APPARATUS

TECHNICAL FIELD

The present invention relates to an image forming apparatus. Specifically, the present invention relates to an approach for achieving an improvement in image quality in an image forming apparatus provided with a duplex printing function.

BACKGROUND ART

Conventionally, as an image forming (printing) operation in an electrophotographic image forming apparatus such as a laser printer, an electrostatic latent image is formed on a photosensitive drum based on image data sent from a host apparatus such as a personal computer (hereinafter, referred to as simply "PC"), toner is affixed to this electrostatic latent image, and image data is made manifest on the photosensitive drum. Afterwards, recording paper transported on a paper transport path is passed between the photosensitive drum and a transfer roller, and the toner image on the photosensitive drum is transferred to the front side of the recording paper. Then, this recording paper passes a fixing roller, and the toner image is fixed by the fixing roller onto the recording paper with heat and pressure.

In recent years, the development of image forming apparatuses of this type provided with a duplex printing function that performs printing on both the front side and the back side of the recording paper has been advancing. The two methods described below are known as methods for this duplex printing.

In the first method, when duplex printing of multiple sheets is requested, among the print data of the front and back side requested to be printed, first, only front side printing (simplex printing) is successively performed across multiple sheets of recording paper with the front-side print data, and these multiple sheets of recording paper for which front side printing is complete are stored in a middle tray. Then, after all front side printing with the front side print data is complete, back side printing is performed for each page of recording paper with back side image data while taking out recording paper stored in the middle tray page by page, and by doing so multiple sheets of recording paper which have been printed on both sides are successively discharged to a discharge tray.

On the other hand, the second method includes, when duplex printing is requested, printing with front and back image data one page at a time. In order to perform duplex printing with this method, it is necessary for a primary transport path and a secondary transport path to be provided as a transport path that transports the recording paper, and to have a recording paper switchback function. That is, after transporting the paper to the primary transport path and performing front side printing, that recording paper is transported to the secondary transport path via the switchback function. Thus the front and back of the recording paper are reversed, the recording paper is again transported to the primary transport path, and printing is performed on the back side of the recording paper.

With the first of the two methods described above, a middle tray is necessary of a size that can store multiple sheets of recording paper, in order to handle the case that multiple sheets of duplex printing are requested. That is, because a large middle tray is necessary, it becomes difficult to achieve a compact design for the image forming apparatus.

Also, with this first method, when multiple sheets of duplex printing are requested, because back side printing is begun after front side printing of all of these multiple sheets is completed, a long time is required until the user obtains recording paper that has been printed on both sides (until the print status of the first page of printed material can be confirmed).

Because there are the problems described above in the first method, in recent years, various image forming apparatuses that perform duplex printing with the second method described above have been developed.

When performing duplex printing with an image forming apparatus using this second method, as stated above, after a toner image is transferred to one side of one sheet of the recording paper, a fixing process is performed that fixes the toner image to that recording paper, and afterwards, back side printing subsequently begins. Because heat fixing is generally performed in the fixing process, the moisture content of the surface of the recording paper used in this fixing process is reduced by fixing heat. As a result, the surface resistance value of the recording paper when performing back side printing is increased in comparison to the surface resistance value of the recording paper when performing front side printing.

When using, for example, A4 size recording paper (below, simply "paper"), the surface resistance value of the paper changes as shown in FIG. 5. That is, during the transfer process (1) in front side printing of the first sheet of paper, the surface resistance value of the paper is $1\times10^{8}$ Ω·cm. In the fixing process (1) performed immediately afterward, the moisture content of the paper surface is lost due to the fixing heat, and the surface resistance value of the paper increases to about $0.5\times10^{10}$ Ω·cm. Afterwards, when switching back the paper (switchback transfer process) in order to perform back side printing of the first sheet of paper, the moisture content inside the paper swells to the paper surface, and thus the surface resistance value of the paper decreases slightly to about $1\times10^{9}$ Ω·cm. Therefore, in the transfer process (2) when printing the back side, transfer is performed to paper having a surface resistance value of $1\times10^{9}$ Ω·cm, but due to going through the subsequent fixing process (2), the surface resistance value of the paper rises again. Also when performing duplex printing of the second and subsequent sheets of paper, similarly, by going through the processes described above, the surface resistance value of the paper changes (see FIG. 5, transfer process (3)—discharge of second sheet of paper complete).

Ordinarily, a constant current control is performed in the transfer process that controls the transfer operation with a constant electric current, but as described above, when performing transfer for duplex printing, when executing a transfer operation with a constant current control to identical paper of a different surface resistance value, the transfer voltage applied to the transfer roller when performing the transfer process is vastly different for front side printing and back side printing. The surface resistance value of the paper (ordinarily, about $1\times10^{6}$ to $1\times10^{10}$ Ω·cm) changes about $1\times10^{1}$ to $1\times10^{2}$ Ω·cm depending on the size of the paper, the moisture content of the paper, the surrounding environment, and the like, and due to the large change in the surface resistance value of the paper that accompanies the fixing process as described above, the transfer voltage when printing the back side may be an applied voltage nearly two times the transfer voltage when printing the front side. This sort of difference in transfer voltage exerts a large influence on the transfer properties for front side printing and back side printing, and invites defects wherein the print quality of the front side and the back side is not the same.

On the other hand, when duplex printing is performed for multiple sheets, when printing the front side of the second and subsequent sheets, print defects are generated due to "photographic fog", described below. Following is an explanation of the circumstances in which this "photographic fog" is generated.

As shown in FIG. 6(*a*), the paper is sandwiched between a transfer roller a and a photosensitive body b, and when transferring the toner image of the photosensitive body b to the paper, the transfer current that flows in the direction of the photosensitive body (electric current of the transfer roller) in the transfer process for the front side of the first sheet of paper is about constant (see the solid line in FIG. 6(*b*)).

Thus, as shown by the solid line in FIG. 6(*c*), the surface electric potential of the photosensitive body b after the transfer process for the front side of the first sheet of paper has been performed (immediately before performing the transfer process for the back side of the first sheet of paper) is roughly constant across the entire photosensitive body b.

However, when performing the transfer process for the back side of the first sheet of paper, because the paper has been through the fixing process when printing the front side, as described above, the resistance value of the paper has increased, and because of that increase in the resistance value the transfer current cannot easily flow. As a method for eliminating such a problem, there is the constant current control system described above that always lets a constant current flow. This method attempts to maintain a constant current by increasing the voltage by the extent that it is difficult for the current to flow.

On the other hand, in a portion h outside the region that paper is arranged (a portion separate from the paper passage region), paper does not lie between the photosensitive body and the transfer roller, current flows easily because resistance is the same as under the condition when performing the transfer process for the front side of the first sheet, and in comparison to when performing the transfer process for the front side of the first sheet, a large amount of current flows on the photosensitive body b outside of the region where paper is arranged. The voltage at this time is the same as for the region where paper is arranged (paper passage region), and is a higher voltage than when performing the transfer process to the front side of the first sheet.

Due to this phenomenon, on the photosensitive body b outside the region where the paper is arranged, the photosensitive body charging and reverse polarity transfer current greatly flows in with a high voltage condition, and as a result the charging potential of the photosensitive body b decreases (a canceling phenomenon due to reverse potential occurs).

Thus, as shown by the broken line in FIG. 6 (*c*), in the photosensitive body b after performing the transfer process for the back side of the first sheet of paper (immediately before performing transfer for the front side of the second sheet of paper), the surface potential of both edges that are outside the region where the paper is arranged decreases. Thus naturally, even in a non-image portion that prevents toner affixing due to the potential difference between the toner and the photosensitive body b, a phenomenon occurs wherein toner is unintentionally affixed onto the photosensitive body b due to the small difference in electric potential (this phenomenon is called photographic fog).

In this way, a state in which photographic fog is generated on the photosensitive body b (a state in which toner is affixed because the surface potential is decreased) continues until the recharging process is performed, that is, until the photosensitive body completes at least one full turn. In this state, when the second page of paper is transported, a fogged image is transferred to the leading edge position corresponding within one full turn of the photosensitive body, and this state is generated when shifted in the axial direction of the photosensitive body relative to the paper passage position due to paper transport variation (positional displacement in the width direction of the paper) when performing back side transfer for the first sheet of paper.

Accordingly, in order to eliminate transfer defects and printing defects in duplex printing as described above, image forming apparatuses have been proposed that control voltage such that the transfer voltage is constant, and do not perform the transfer process with a constant current control (for example, see JP 2002-49184A). Image forming apparatuses have also been proposed that perform the transfer process by constant current control, reduce residual electric potential on the photosensitive body by de-electrifying the photosensitive body, and make the transfer voltage constant (for example, see JP 2002-23576A).

However, when making the transfer voltage constant by the methods disclosed in JP 2002-49184A and JP 2002-23576A, there is much damage to the photosensitive body, inviting a deterioration in the life properties of the photosensitive body. That is, with the image forming apparatus disclosed in JP 2002-23576A, because de-electrification of the photosensitive body is performed with a de-electrifying voltage of opposite polarity to the charging properties of the photosensitive body, it is possible that this will lead to a deterioration in the life properties of the photosensitive body. Also, with the image forming apparatus disclosed in JP 2002-49184A, change occurs in the resistance value of the printing paper due to changing the environment of the apparatus for constant voltage control, and a change in the optimum voltage occurs. The voltage to the photosensitive body changes, damage is conferred on the photosensitive body, and in this case as well leads to a deterioration in the life properties of the photosensitive body.

The present invention was made in consideration of the circumstances described above, and it is an object thereof to provide an image forming apparatus provided with a duplex printing function, wherein a deterioration in life properties of the photosensitive body is not invited, and wherein print defects due to "photographic fog" can be decreased.

DISCLOSURE OF INVENTION

—Overview of the Invention—

In order to achieve the object stated above, the present invention adopts a configuration wherein by changing the paper passage position when printing the front side and the paper passage position when printing the back side with a shifter function, there is no decrease in the life characteristics of the photosensitive body, and it is possible to decrease defective printing caused by photographic fog.

—Solving Means—

Specifically, an image forming apparatus is presumed that has a duplex printing function, wherein while transporting a recording medium, after recording an image formed on an image carrier to a first side of the recording medium, this recording medium is re-transported towards the image carrier and an image formed on the image carrier is recorded on a second side of this recording medium that differs from the first side. The image forming apparatus is provided with a switching means for switching the transport position of the recording medium when recording the image on the recording medium, such that it differs in the direction perpendicular to the recording medium transport direction when recording the image on the first side and when recording the image on the second side.

When performing duplex printing, by changing the surface resistance value of the recording medium (for example, recording paper) that passes the image carrier, the surface electrical potential of the image carrier at a position that does not make contact with the recording medium is decreased. This sort of decrease in the surface electric potential causes photographic fog to be generated on the image carrier, and in the conventional technology, when performing recording on the second and subsequent sheets of the recording medium, printing defects are generated if the transport position shifts even a slight amount. In the present invention, when performing duplex printing on one sheet of the recording medium, by changing the transport position in the manner described above, the region in which the surface electric potential of the photosensitive body increases is diminished, and the region in which photographic fog is generated is made smaller. Thus, when recording on the second and subsequent sheets of the recording medium, even when a slight amount of displacement of the transport position of the recording medium occurs, it is possible to suppress that recording paper making contact in the region that photographic fog occurs on the image carrier, and printing defects caused by photographic fog on the recording medium can be prevented.

The transport position of the recording medium may be set such that it differs about 10 to 30 mm when recording image information on the first side (front side) and when recording image information on the second side (second side).

Also, the transport position of the recording medium when recording image information on either the first side or the second side of the recording medium is set to a standard paper passing position of the recording medium in the image carrier.

According to the configuration described above, the transport position of the recording medium when recording image information on either the first side or the second side is the transport position to which the recording medium is transported by simplex printing (standard paper passage position of the image carrier). Thus, even if duplex printing is performed by the image forming apparatus and the transport position of the recording medium is changed, the life properties of the image carrier can be maintained roughly constant. That is, not only duplex printing but also simplex printing is performed by the image forming apparatus, and so in order to appropriately exchange the image carrier according to deterioration of the image carrier, it is preferable that the recording medium is transported in the same manner when performing duplex printing as when performing simplex printing. That is, in the manner of the present invention, even when changing the transport position of the recording medium when performing duplex printing, by setting the standard paper passage position of the recording medium in the image carrier such that the recording medium is passed when recording at least one side, it is possible to keep the deterioration status of the image carrier roughly constant. By doing so it is easy for the user or manufacturer to know the deterioration status of the image carrier, and accordingly it is possible to appropriately manage exchange of the image carrier.

Also, a discharge portion for discharging the recording medium on which the image has been printed is provided, and the switching means is provided in this discharge portion. This switching means has an offset function that varies the discharge position of the recording medium that is discharged. The transfer position of the recording medium when recording an image on the recording medium is switched by the offset function of the switching means.

According to the configuration described above, the transfer position of the recording medium is switched by the offset function (shifter function) used when discharging the recording medium, and so enlargement of the apparatus is not invited.

The invention also provides a configuration wherein the image forming apparatus is provided with an optical unit that writes image information on the image carrier, and when writing image information on the image carrier, the optical unit separately sets an image information writing point for recording the image to the first side of the recording medium, and an image information writing point for recording the image to the second side of the recording medium.

According to the configuration described above, when performing duplex printing with this image forming apparatus, even if the transport position of the recording medium is changed, the image information writing point is appropriately set according to the transport position of the recording medium, and so it is possible to record the image to a predetermined position of the recording medium. Thus, even when performing duplex printing, the image recording position does not differ for the first side and the second side.

Also, the optical unit is provided with a writing timing detection sensor that sets the timing for writing image information onto the image carrier, and that writing point is set by changing the writing timing from the writing timing detection sensor.

According to the configuration described above, the timing at which image information is recorded to the first side or the second side is controlled by the writing timing detection sensor. Thus, the writing point is appropriately set according to the transfer position of the recording medium. As a result, when duplex printing is performed by the image forming apparatus, even if the transfer position of the recording medium is changed, it is possible to record image information to a predetermined position of the recording medium.

Further, the transfer position of the recording medium is set to a region in which it is possible to operate a plurality of transfer rollers disposed in the transfer path of the recording medium, the image carrier, a fixing mechanism, a transfer mechanism, and, a developing mechanism disposed in the vicinity of the image carrier, various charging mechanisms, and a cleaning mechanism.

The transfer position of the recording medium is set to a region in which it is possible to operate a plurality of transfer rollers disposed in the transfer path of the recording medium, the image carrier, a fixing mechanism, a transfer mechanism, and, a developing mechanism disposed in the vicinity of the image carrier, various charging mechanisms, and a cleaning mechanism. Thus, when performing duplex printing with the image forming apparatus, even if the transfer position of the recording medium is changed, it is possible to appropriately perform recording of an image to the recording medium because the operation of the various structures described above is appropriately performed.

In addition, the transfer position of the recording medium is switched such that it differs when recording an image to the first side and when recording an image to the second side, and satisfies the relational expression $$(\text{Distance of change in the transport position}) < [(\text{width of the image carrier}) - (\text{maximum width of the recording medium used for printing})]/2.$$

According to the configuration described above, when performing duplex printing with the image forming apparatus, even if the transfer position of the recording medium is changed, it is possible to appropriately transfer the image information that is formed on the image carrier onto the recording medium. That is, by changing the transport position of the recording medium such that the above relational expression is satisfied, it is possible to record the image information formed on the image carrier such that it does not protrude beyond the edge of the recording medium.

BEST MODE FOR CARRYING OUT THE INVENTION

Hereinafter, the present invention will be described by way of illustrative embodiments with reference to the drawings. In the present embodiment, the present invention is described with regard to its application in a compound machine provided with a copy function, a print function, and a facsimile function. In this embodiment, any paper such as image forming paper or recording paper can be used as a recording medium, but the recording medium is not restricted to these. Other forms of recording media may also be used, such as overhead projector sheets, for example.

Embodiment 1

—Explanation of the Overall Configuration of the Compound Machine—

Figure 1:
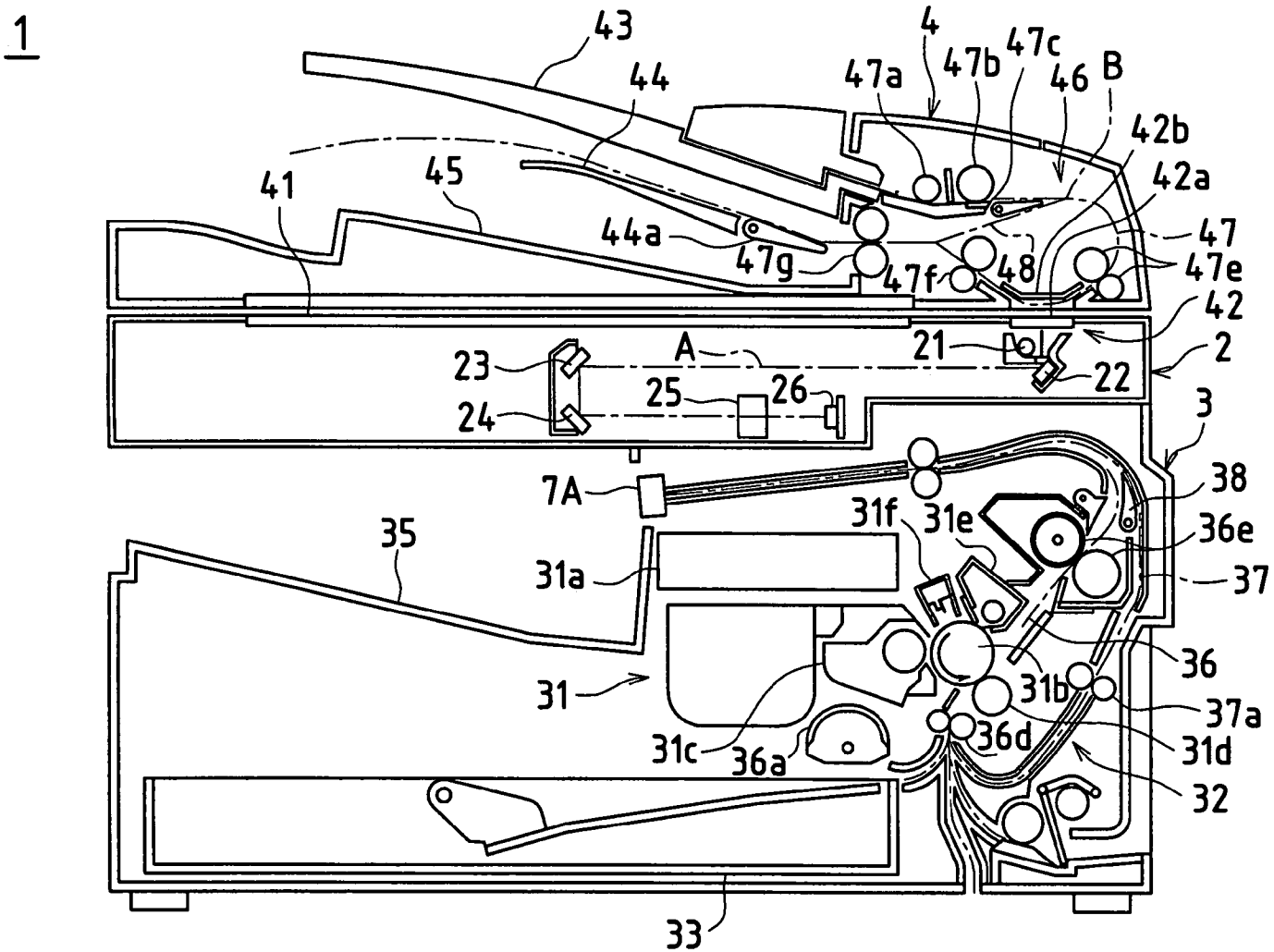
FIG. 1 is a drawing that schematically shows an internal structure of a compound machine according to an embodiment.

FIG. 1 schematically shows an overview of the internal structure of a compound machine 1 as an image forming apparatus according to the present embodiment. As shown in FIG. 1, the compound machine 1 includes a scanner portion 2, a print portion 3 as an image forming portion, and an automatic manuscript paper supply portion 4. These parts are described below.

<Description of the Scanner Portion 2>

The scanner portion 2 reads the image of a manuscript placed on a manuscript rest 41 that is made of transparent glass, or the like, or the image of a manuscript that is supplied sheet by sheet from the automatic manuscript paper supply portion 4, and creates image data. This scanner portion 2 includes an exposure light source 21, a plurality of reflective mirrors 22, 23, and 24, an imaging lens 25, and a photoelectric transducer (CCD: Charge Coupled Device) 26.

The exposure light source 21 irradiates light onto the manuscript that is placed on the manuscript rest 41 of the automatic manuscript paper supply portion 4 or the manuscript carried by the automatic manuscript paper supply portion 4. As shown in FIG. 1 by the dotted line A indicating the optical path, the reflective mirrors 22, 23, and 24 are set so as to first reflect the light that is reflected from the manuscript to the left of the diagram, after which they reflect the light downward, and after which they then reflect the light rightward toward the imaging lens 25.

As the operation to read the image of the manuscript, if the manuscript is placed on the manuscript rest 41 (if used in the "stationary sheet mode"), then the exposure light source 21 and the reflective mirrors 22, 23, and 24 horizontally scan the manuscript stand 41 to read in the image of the entire manuscript. On the other hand, if reading in a manuscript that is carried by the automatic manuscript paper supply portion 4 (if used in the "moving sheet mode"), the exposure light source 21 and the reflective mirror 22 are fixed in the position shown in FIG. 1, and the image of the manuscript is read in as the manuscript passes a reading portion 42 of the automatic manuscript paper supply portion 4, described later. This reading portion 42 is configured of a manuscript pressing board 42*b* described below, the exposure light source 21, the reflective mirrors 22, 23, and 24, the imaging lens 25, and the photoelectric transducer 26.

Light that is reflected by the reflecting mirrors 22, 23, and 24 to pass through the imaging lens 25 is guided to the photoelectric transducer 26, and the reflected light is converted into an electrical signal (manuscript image data) by the photoelectric transducer 26.

<Description of the Print Portion 3>

The print portion 3 includes an image forming system 31 and a paper transport system 32.

The image forming system 31 includes a laser scanning unit 31*a* as the optical unit named in the present invention and a photosensitive drum 31*b* as a drum-type image transport body. The laser scanning unit 31*a* irradiates laser light onto the surface of the photosensitive drum 31*b*, based on the manuscript image data that is converted by the photoelectric transducer 26. The photosensitive drum 31*b* rotates in the direction of the arrow shown in FIG. 1, and an electrostatic latent image is formed on its surface by laser light irradiated from the laser scanning unit 31*a*.

In addition to the laser scanning unit 31*a*, a developing apparatus (developing mechanism) 31*c*, a transfer roller 31*d* that constitutes a transfer mechanism, a cleaning apparatus (cleaning mechanism) 31*e*, a de-electrifier not shown in the drawings, and a charging unit 31*f* are circumferentially arranged in order around the photosensitive drum 31*b*. The developing apparatus 31*c* uses toner (a substance for forming a manifest image) to develop the electrostatic latent image formed on the surface of the photosensitive drum 31*b* into a visible image. The transfer unit 31*d* transfers the toner image formed on the surface of the photosensitive drum 31*b* onto a piece of image forming paper that is a recording medium. The cleaning apparatus 31*e* removes toner remaining on the surface of the photosensitive drum 31*b* after toner transfer. The de-electrifier removes a residual electric charge from the surface of the photosensitive drum 31*b*. The charging unit 31*f* provides a predetermined electric potential to the surface of the photosensitive drum 31*b* before the electrostatic latent image is formed.

Thus, when forming an image on the image forming paper, the surface of the photosensitive drum 31*b* is charge to a predetermined electric potential by the charging unit 31*f*, and then the laser scanning unit 31*a* irradiates laser light onto the surface of the photosensitive drum 31*b* based on the manuscript image data. After this, the developing apparatus 31*c* uses toner to develop a visible image on the surface of the photosensitive drum 31*b*, and the toner image is transferred to image forming paper by the transfer unit 31*d*. Further still, after this, the cleaning apparatus 31*e* removes the toner remaining on the surface of the photosensitive drum 31*b* and the de-electrifier removes the electric charge remaining on the surface of the photosensitive drum 31*b*. Thus, one cycle of the operation to form an image on the image forming paper (printing operation) is complete. By repeating this cycle, it is possible to successively form images on a plurality of sheets of image forming paper.

On the other hand, the paper transport system 32 carries image forming paper contained in a paper cassette 33, which is a paper containing portion, sheet by sheet to form images according to the image forming system 31, and discharges the image forming paper on which an image has been formed to a discharge tray 35, which is a paper discharge portion.

The paper transport system 32 is provided with a principal transport path 36 and a reverse transport path 37. One end of the principal transport path 36 faces the discharge side of the paper cassette 33, while the other end faces a discharge tray 35. One end of the reverse transport path 37 is upstream (below, in the drawing) of the arranged position of the transfer roller 31*d* and is connected to the principal transport path 36, and the other end is downstream (above, in the drawing) of the arranged position of the transfer unit 31*d* and is connected to the principal transport path 36.

The upstream end of the principal transport path 36 (the part facing the discharge side of the paper cassette 33) is provided with a pickup roller 36*a* whose cross-section is semicircular. Image forming paper contained in the paper cassette 33 can be intermittently supplied sheet by sheet into the principal transport path 36 by rotating the pickup roller 36*a*.

Register rollers 36*d* are arranged in the principal transport path 36 on the upstream side of the transfer roller 31*d*. The register rollers 36*d* are rollers for transporting the image forming paper while matching the position of the toner image on the surface of the photosensitive drum 31*b* to the image forming paper. A pair of fixing rollers 36*e* using heat to fix the toner image that is transferred to the image forming paper are arranged in the principal transport path 36 on the downstream side of the position where the transfer roller 31*d* is arranged. Moreover, as a discharge portion for discharging the image forming paper to the discharge tray 35, a discharge unit 7A is arranged at the downstream end of the principal transport path 36, and a shifter mechanism 7 (see FIG. 2) is stored in this discharge unit 7A as a switching means, described below.

A branch catch 38 is arranged at the position at which the upstream end of the reverse transport path 37 connects to the principal transport path 36. The branch catch 38 is rotatable around a horizontal axis between a first position, which is shown by a solid line in FIG. 1, and, rotating in a counter-clockwise direction in FIG. 1 from the first position, a second position opening the reverse transport path 37. When the branch catch 38 is in the first position, the image forming paper is carried toward the discharge tray 35, and when it is in the second position, the image forming paper can be delivered into the reverse transport path 37. Transport rollers 37*a* are arranged in the reverse transport path 37, and the paper transport system 32 is arranged such that if the image forming paper is delivered into the reverse transport path 37 (if the image forming paper is fed into the reverse transport path 37 by what is known as "switchback transport"), then the image forming paper is transported by the transport rollers 37*a* and the image forming paper is reversed on the upstream side of the register roller 36*d*, and is again carried along the principal transport path 36 toward the transfer roller 31*d*. That is to say, it is handled such that an image may be formed on the back side of the image forming paper.

<Description of the Automatic Manuscript Paper Supply Portion 4>

The following is a description of the automatic manuscript paper supply portion 4. The automatic manuscript paper supply portion 4 is configured as what is known as an automatic two-sided manuscript transport apparatus. The automatic manuscript paper supply portion 4 can be used for a sheet moving mode and is provided with a manuscript tray 43 as a manuscript placement portion, a middle tray 44, a manuscript discharge tray 45 as a manuscript discharge portion, and a manuscript transport system 46 that transports manuscripts between the trays 43, 44, and 45.

The manuscript transport system 46 is provided with a principal transport path 47 for transporting manuscripts placed on the manuscript tray 43 to the middle tray 44 via the manuscript reading portion 42 or the manuscript discharge tray 45, and a secondary transport path 48 for supplying manuscripts on the middle tray 44 to the principal transport path 47.

A manuscript pickup roller 47*a* and a stacking roller 47*b* are arranged at an upstream end (a portion facing the discharge side of the manuscript tray 43) of the principal transport path 47. A stacking board 47*c* is arranged below the stacking roller 47*b* and, due to the rotation of the manuscript pickup roller 47*a*, one sheet of the manuscripts on the manuscript tray 43 passes between the stacking roller 47*b* and the stacking board 47*c* such that it is supplied to the principal transport path 47. PS rollers 47*e* are arranged on a side lower than the linking area between the principal transport path 47 and the secondary transport path 48 (area B in the drawing). The PS rollers 47*e* regulate the leading edge of the manuscript and the image reading timing of the scanner portion 2 when supplying manuscripts to the manuscript reading portion 42. That is, the PS rollers 47*e* temporarily stop the transport of the manuscript in the state in which the manuscript was supplied, and regulate the image reading timing when supplying manuscripts to the manuscript reading portion 42.

The manuscript reading portion 42 is provided with a platen glass 42*a* and a manuscript pressing board 42*b* and, when a manuscript supplied from the PS rollers 47*e* passes through between the platen glass 42*a* and the manuscript pressing board 42*b*, light from the above-mentioned exposure light source 21 passes through the platen glass 42*a* and is irradiated on the manuscript. At this juncture, manuscript image data is obtained by the above-mentioned scanner portion 2. A biasing force is applied to the back surface (top surface) of the manuscript pressing board 42*b* by an unshown coil spring. In this way, the manuscript pressing board 42*b* makes contact against the platen glass 42*a* with a predetermined suppressing force, thus preventing the manuscript from rising up from the platen glass 42*a* when the manuscript passes through the manuscript reading portion 42.

Transport rollers 47*f* and manuscript discharge rollers 47*g* are provided on a downstream side of the platen glass 42*a*. A manuscript that passes over the platen glass 42*a* is discharged to the middle tray 44 or the manuscript discharge tray 45 via the transport rollers 47*f* and the manuscript discharge rollers 47*g*.

A middle tray swinging board 44*a* is arranged between the manuscript discharge rollers 47*g* and the middle tray 44. The middle tray swinging board 44*a* has its swinging center at an edge area of the middle tray 44 and is able to swing between a position 1 shown in the drawing by a solid line and a position 2 in which it is raised upwards from the position 1. When the middle tray swinging board 44*a* is in the position 2, a manuscript discharged from the manuscript discharge rollers 47*g* is withdrawn to the manuscript discharge tray 45. On the other hand, when the middle tray swinging board 44*a* is in the position 1, a manuscript discharged from the manuscript discharge rollers 47*g* is discharged to the middle tray 44. When a manuscript is discharged to the middle tray 44, an edge of the manuscript is sandwiched between the manuscript discharge rollers 47*g*, and by reversing the rotation of the manuscript discharge rollers 47*g* while in this condition, the manuscript is supplied to the secondary transport path 48 and is again dispatched to the principal transport path 47 via the secondary transport path 48. The operation of reversing the rotation of the manuscript discharge rollers 47*g* is carried out by regulating the dispatch of the manuscript to the principal transport path 47 and the timing of image reading. In this way, an image on the reverse side of a manuscript can be read by the manuscript reading portion 42.

—Description of Basic Operation of the Compound Machine—

As the operation of the compound machine 1 configured as described above, first, this compound machine 1, when it functions as a printer, receives print data (image data or text data) sent from a host apparatus such as a personal computer, and stores this received print data in a buffer (memory) not shown. Along with storing this print data in the buffer, print data is read out from the buffer in sequence, and based on this read out print data, an image is formed on image forming paper by the image forming operation of the print portion 3 described above.

Also, when this compound machine 1 functions as a scanner, it stores the scan image data of the manuscript read by the scanner portion 2 in the buffer. Along with storing this scan image data in the buffer, it sends the scan image data in sequence from the buffer to the host apparatus, and shows the image on a display of this host apparatus.

Further, when this compound machine 1 functions as a copy machine, an image is formed on image forming paper by the image forming operation of the print portion 3, based on the manuscript image data read by the scanner function.

—Description of the Shifter Mechanism—

As one characteristic of the present embodiment, the shifter mechanism (offset mechanism) 7 is provided to discharge image forming paper while shifting the paper discharge position, and this is effectively utilized when duplex printing is performed. Following is a description of the shifter mechanism 7.

As described above, a shifter mechanism 7 is provided in a discharge unit 7A disposed at the downstream end of the principal transport path 36 of the print portion 3. The original function of this shifter mechanism 7 is to shift the position of discharged paper (in the direction perpendicular to the paper discharge direction) copy by cop such that it is possible to discriminate the individual copies of the printed documents when printing multiple copies.

Figure 2:
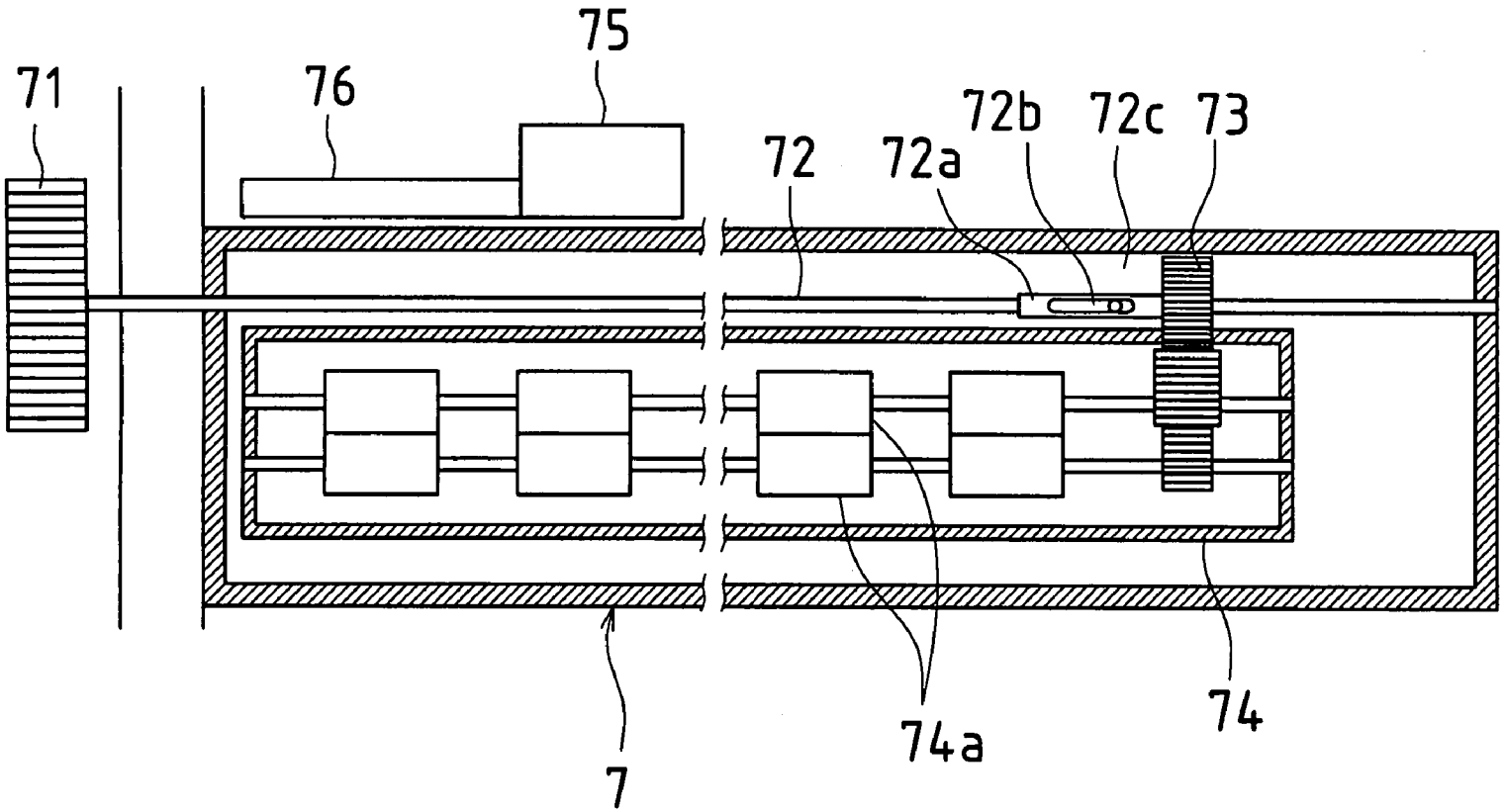
FIG. 2 is a cross-sectional view of the shifter mechanism.

FIG. 2 is a cross-sectional view (cross-section through a plane perpendicular to the paper discharge direction) of the shifter mechanism 7. As shown in FIG. 2, in the shifter mechanism 7, a shaft 72 is rotatively driven by a driving gear 71 that receives driving force from an unshown driving source of the compound machine 1. This shaft 72 is connected to a linking gear 73 via a connecting member 72*a*, and rotates together with the linking gear 73. Also, offset rollers 74*a* that receive driving force from the linking gear 73 and rotate are disposed in a box-shaped offset portion 74 that is disposed below this linking gear 73 in the drawing. Thus, the shaft 72 is driven by the driving gear 71, which in turn is driven by the driving force from the apparatus driving source, and the offset rollers 74*a* provided in the offset portion 74 are rotatively driven, thus transporting the paper. These offset rollers 74*a* can rotate in reverse according to the direction of rotation of the driving gear 71, and can rotate in the direction that discharges paper or in the direction that feeds paper back towards the reverse transport path 37.

Also, the shifter mechanism 7 can move the position of the offset portion 74 in the horizontal direction using an offset driving source 75 and an offset gear group 76. That is, the connecting member 72*a* has an elongated linking gear slide hole 72*b*, such that the linking gear 73 linked to the shaft 72 can slide along the shaft 72 within a predetermined range. A boss 72*c* protruding from the shaft 72 is disposed in this elongated linking gear slide hole 72*b*. Thus, when the connecting member 72*a* is shifted by the offset gear group 76 such that the relative position of the boss 72*c* in the elongated linking gear slide hole 72*b* moves, the linking gear 73 also shifts and the position of the offset portion 74 shifts. The position of the offset rollers 74*a* is also shifted according to the shift of this offset portion 74.

In this manner, it is possible to shift the discharge position of the recording paper (shift in the direction perpendicular to the paper transport direction) by shifting the position of the offset rollers 74*a* along with the offset portion 74. In the present embodiment, by utilizing this shifter function and switching back the recording paper, during duplex printing, the transport position of the recording paper is shifted when printing the front side and rear side.

—Description of the Copy Operation—

Following is an explanation of the compound machine (image forming apparatus) 1 of the configuration described above when it functions as a copy machine (copier mode). After a user places a manuscript he desires to print on the manuscript rest 41, furnishes recording paper in the paper cassette 33, and operates the condition input keys (number of pages to print/print zoom etc.) on an unshown operating panel disposed on the front of the housing of the compound machine 1, the copy operation begins when a start key is pressed down.

When beginning the copy operation in this manner, first, a main driving motor starts at roughly the same time that the start key is pressed, and the driving gears rotate. Next, the pickup roller 36*a* rotates and recording paper is supplied, and this recording paper reaches the register roller 36*d*. At this point, in order to synchronize with the leading edge of the image formed on the photosensitive drum 31*b*, the recording paper temporarily halts, and the position of the leading edge of the recording paper is corrected by uniformly pressing the recording paper against the register roller 36*d*.

On the other hand, in the scanner portion 2, the exposure light source 21 lights up, and a copy lamp unit configured of this exposure light source 21 and reflective mirrors 22, 23, and 24 shifts in a direction parallel to the manuscript stand 41, beginning exposure of image information of the manuscript being read in. Irradiation light that includes the image information obtained by irradiating the manuscript with the exposure light source 21 is read by passing from the first mirror 22 to the second mirror 23 and the third mirror 24, and though the optical lens 25, and being input into the CCD 26.

The image information (incident light) read in this way is converted to an electrical signal, by a CCD circuit of an unshown control portion, image processing of that image information signal is performed with the set conditions, and the signal is sent to the laser scanning unit (LSU) 31*a* as print data.

Figure 3:
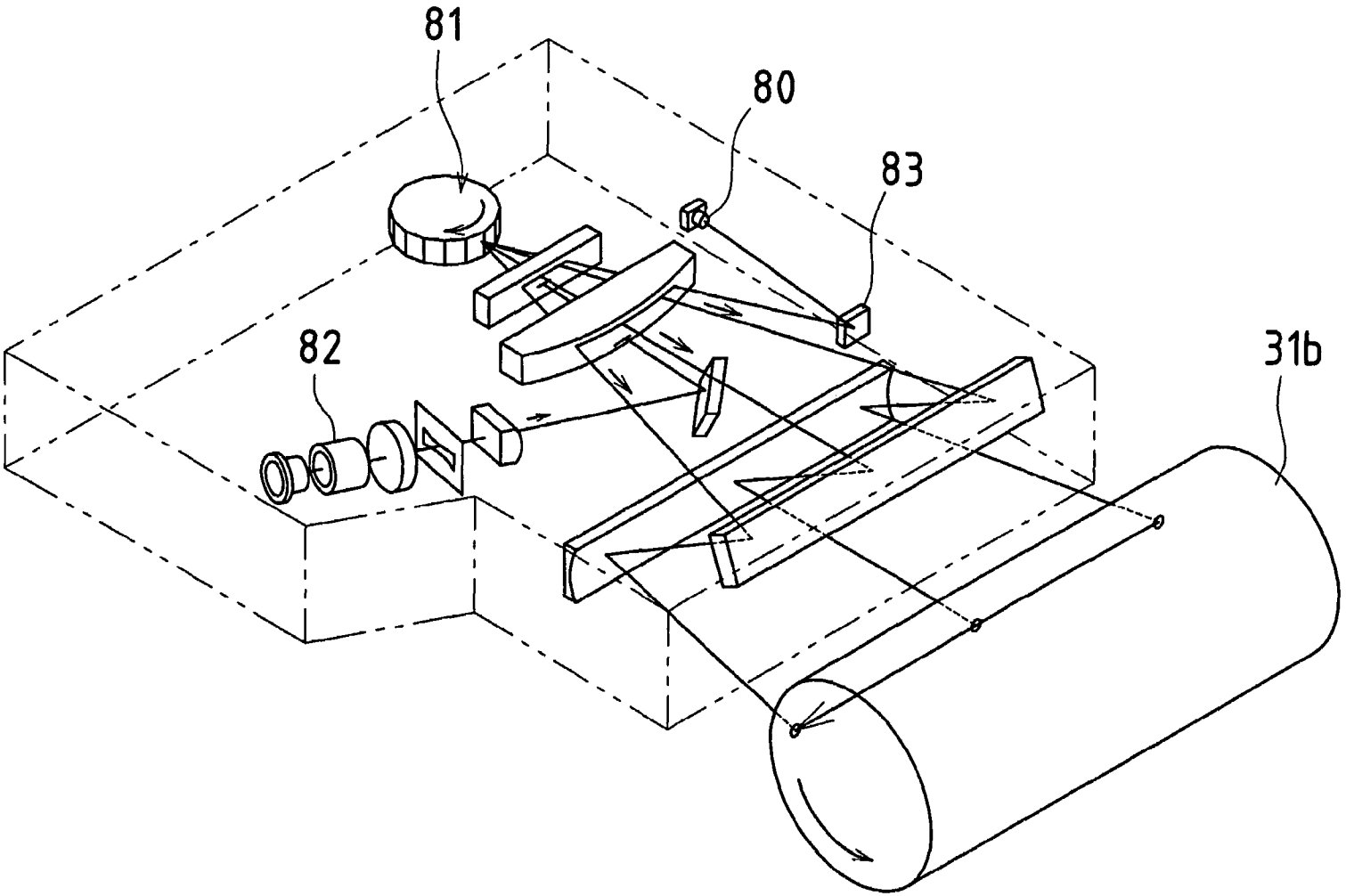
FIG. 3 is a perspective view that shows the schematic structure of the laser scanning unit.

Meanwhile, the photosensitive drum (image carrier) 31*b* is charged by the charging unit 31*f* to a predetermined charging potential. The laser beam from the laser scanning unit 31*a*, as shown in FIG. 3, passes a polygon mirror 81 and various lenses and is irradiated on the photosensitive drum 31*b*, and an electrostatic latent image is formed on the photosensitive drum 31*b*. After that, the toner on an MG roller in the developing cell of the developing apparatus 31*c* is attracted onto the surface of the photosensitive drum 31*b*, the electrostatic latent image is made manifest with toner according to the electric potential gap on the photosensitive drum 31*b*, and a toner image is obtained.

The recording paper on which an image is formed is carried in the direction of the photosensitive drum 31*b* (principal transport path 36) by the register roller 36*d* matching the timing for the positioning of the toner image on the surface of the photosensitive drum 31*b* and the image forming paper, and the toner on the photosensitive drum 31*b* is transferred to the recording paper by the transfer roller 31*d*. Toner remaining on the photosensitive drum 31*b* is scraped off by the cleaning blade of the cleaning apparatus 31*e* and recovered.

Recording paper for which toner transfer is complete passes an upper heat roller and a lower heat roller (the above-noted fixing rollers 36*e*) of the fixing apparatus (fixing mechanism), heat and pressure is applied, unfixed toner on the recording paper is melted and fixed, and discharged to the discharge tray 35 through the discharge unit 7A.

At this point, when duplex printing is performed for the recording paper, the front edge and rear edge of the recording paper, which has passed the fixing rollers 36*e*, are reversed by the switchback function, and the recording paper is transported on the reverse transport path 37. Then, as described above, the timing of the recording paper is set by the register roller 36*d* to synchronize with the photosensitive drum 31*b*, and it is transported in the direction of the photosensitive drum 31*b* (principal transport path 36). Printing is performed for the back side of the recording paper, and then it is discharged to the discharge tray 35.

In the present embodiment, the shifter mechanism 7 provided in the discharge unit 7A is used when performing the switchback, and the transport position of the recording paper is shifted. That is, the transport position of the recording paper, whose surface (a first surface) has been printed, is first shifted by the shifter mechanism 7, afterwards switchback is performed, the recording paper is transported on the reverse transport path 37, and printing is performed on the back side (second surface) of the recording paper. Thus, when performing duplex printing, the transport position of the recording paper on the photosensitive drum 31*b*, the transfer roller 31*d*, the fixing position and the like differs when printing the front side and when printing the back side.

The transport position of the recording paper (paper transport position) is set so that the position of the recording paper when printing the front side is a standard position set in advance by the compound machine 1. In other words, the shifter mechanism 7 is driven such that the paper transport position when printing the back side of the recording paper is shifted from the standard paper transport position (in the present embodiment, standard paper passing position of the recording paper for the photosensitive drum 31*b*) that is set in the compound machine 1. This is because not only duplex printing is performed by the compound machine 1; single-sided printing is also performed. Thus, in order to keep the properties for lifetime of the photosensitive drum 31*b* about constant, it is preferable to set the paper transport position when printing either the back or the front of the recording paper to be the standard paper transport position that has been set in the compound machine 1. By doing so, it is possible to make it easier to manage replacement of the photosensitive drum 31*b* due to deterioration or the like.

Also, it is preferable that the paper transport position of the recording paper in the compound machine 1 is within the region that the register roller 36*d* disposed along the paper transport path that the recording paper is transported, the photosensitive drum 31*b*, the fixing roller 36*e*, the transfer roller 31*d*, the developing apparatus 31*c* disposed in the vicinity of the photosensitive drum 31*b*, the charging unit 31*f*, and the cleaning apparatus 31*e* can operate. If so, it is possible to suitably transfer and print on the recording paper even if the transport position of the recording paper changes when performing duplex printing.

Further, it is preferable that the paper transport position, which changes by printing on the front side or the back side (changing distance of the paper transport position), is given by the following relational expression.

$$\text{(Distance of change in paper transport position)} < [(\text{width of photosensitive drum}) - (\text{maximum width of recording paper used for printing})]/2$$

Here, the maximum width of recording paper used for printing indicates a recording paper having the maximum size among recording papers for which printing by the compound machine 1 is possible. By the distance of the change in the paper transport position satisfying the above relational expression, when printing, it is possible for the toner image formed on the photosensitive drum 31*b* to be transferred onto the recording paper.

Further, because the paper transport position is changed when printing the front side and when printing the back side, it is necessary to modify the timing of writing from the optical unit, such as the laser scanning unit 31*a*, to the photosensitive drum 31*b*. This timing is controlled by a writing timing detection sensor that is provided in the optical unit. That is, a writing timing detection sensor 80, as shown in FIG. 3, emits part of the light incident to the polygon mirror 81 from the laser light source 82 to a different position than the writing region where writing is performed on the photosensitive drum 31*b*, and reflects it with the reflective mirror 83. When reflected light is received by the sensor 80, writing to the surface of the photosensitive drum 31*b* begins after passage of a predetermined amount of time.

In the compound machine 1 according to the present embodiment, because the paper transport position differs when performing duplex printing, it is necessary to have a front side writing point and a back side writing point as writing points on the surface of the photosensitive drum 31*b*. As described above, because writing on the photosensitive drum 31*b* begins after reflected light is received by the sensor 80 and a predetermined amount of time has passed, by changing the predetermined amount of time that passes until writing begins, it is possible to vary the timing at which writing occurs. That is, it is possible to change the writing points for front side printing and back side printing by altering the timing of the writing.

In the above manner, the compound machine 1 of the present embodiment has a switchback function, and a transfer voltage of the transfer process is applied in accordance with a predetermined electrical current control. The change in the current of the transfer roller 31*d* and in the surface electric potential of the photosensitive drum 31*b* in the transfer process performed by this compound machine 1 are explained with reference to FIG. 4.

Figure 4:
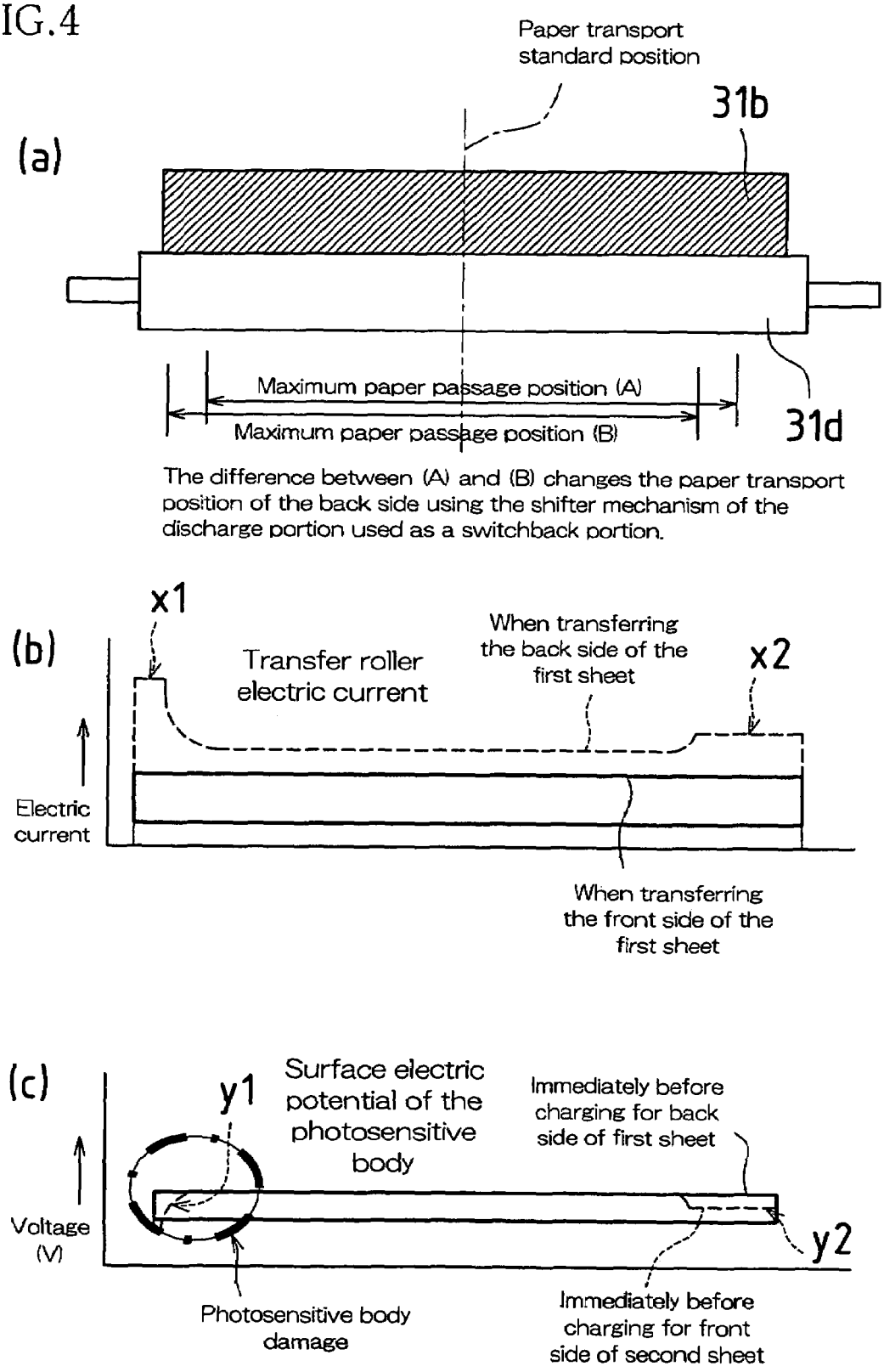
FIG. 4 is a drawing that illustrates the electric current of the transfer roller and the change in the surface electric potential of the photosensitive drum in the transfer process according to an embodiment.
Figure 5:
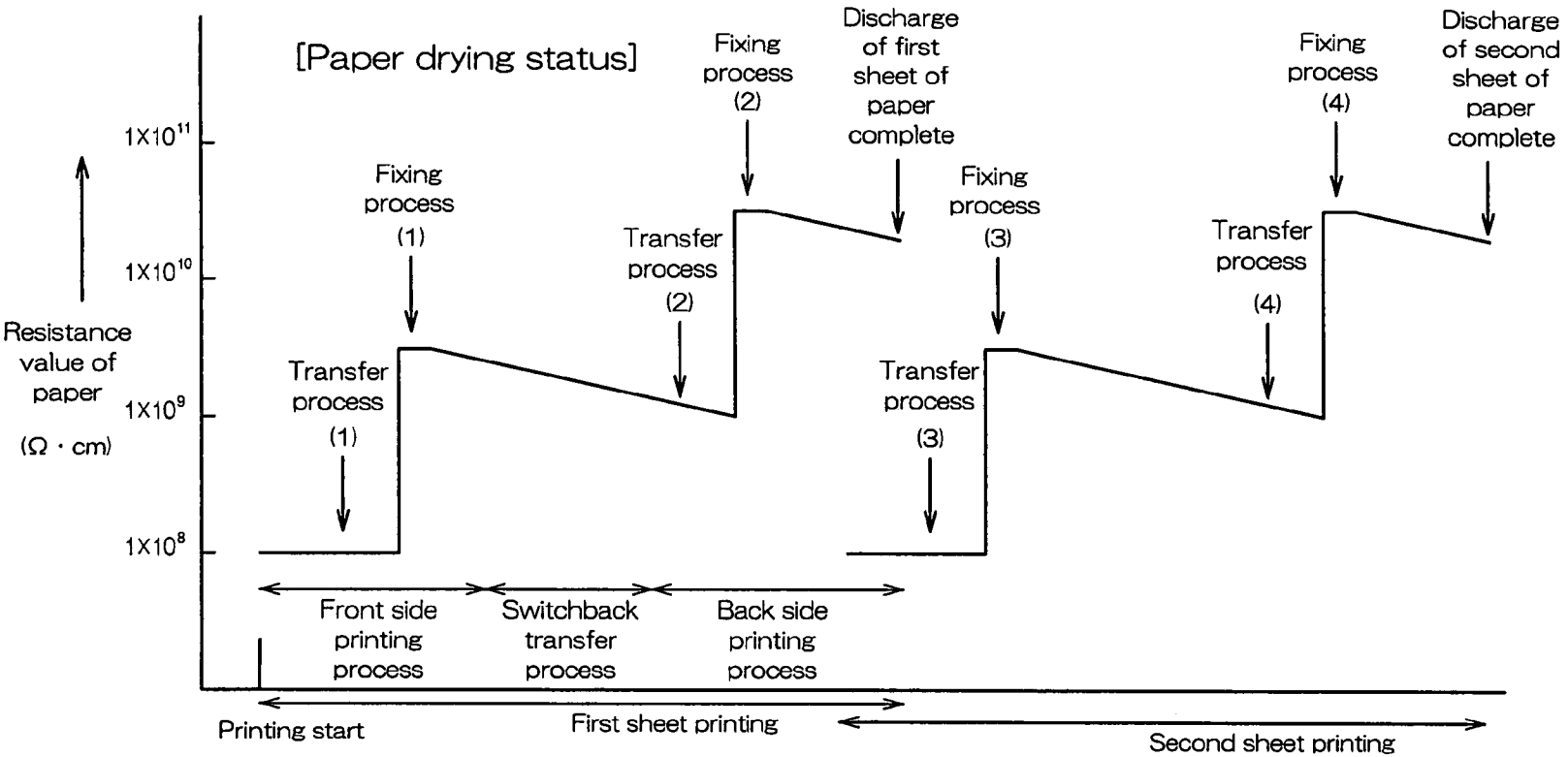
FIG. 5 is a drawing that illustrates the change in the surface resistance value of the paper.
Figure 6:
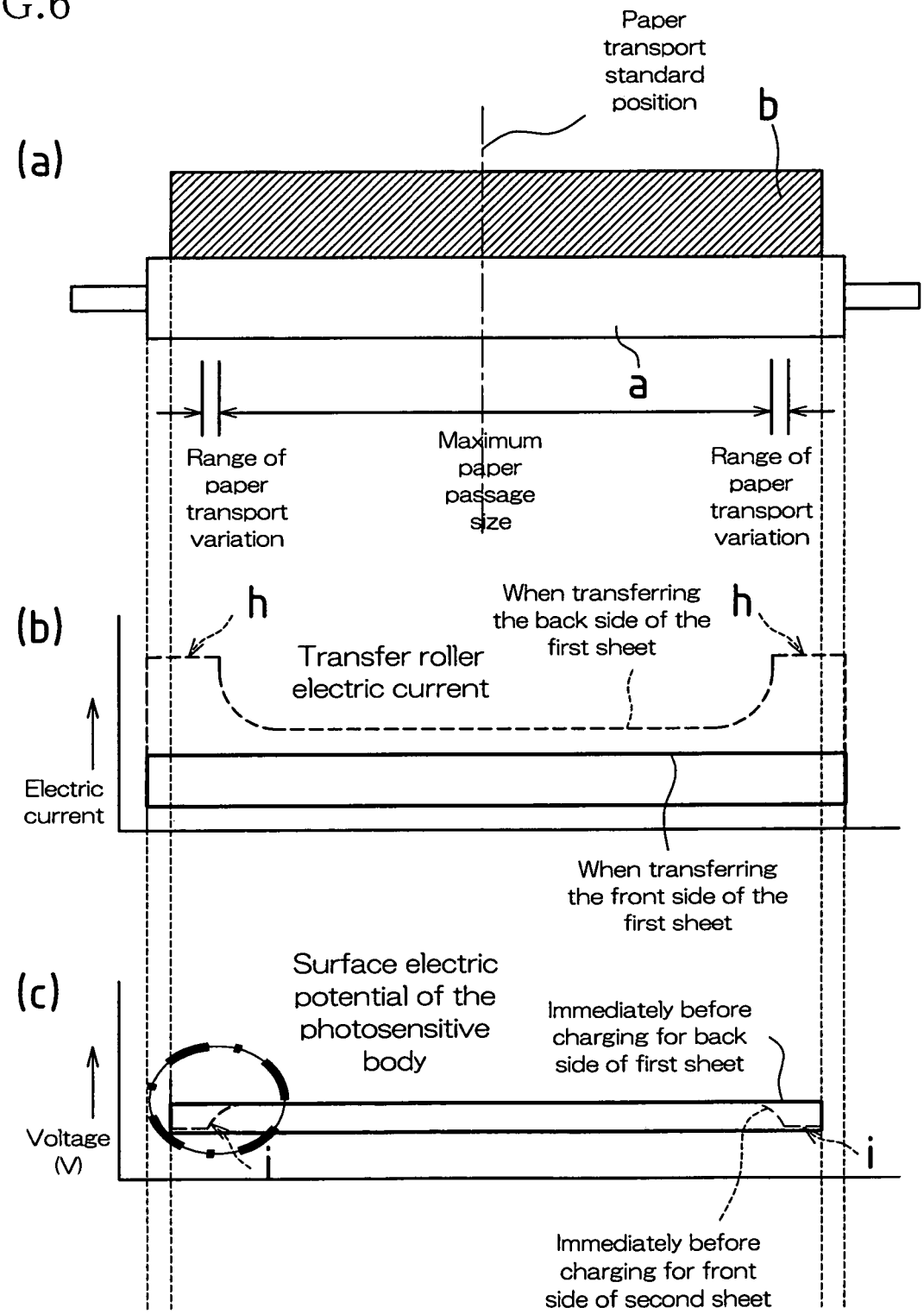
FIG. 6 is a drawing that illustrates the electric current of the transfer roller and the change in the surface electric potential of the photosensitive drum in the transfer process according to the conventional technology.

In the compound machine 1, as shown in FIG. 4(*a*), recording paper is sandwiched between the transfer roller 31*d* and the photosensitive drum 31*b* (hereinafter, photosensitive body), and the toner image on the photosensitive body 31*b* is transferred to the recording paper. In the transfer process for the front side of the first sheet of paper, the recording paper is transferred such that it passes the maximum paper passage position (A) shown in FIG. 4(*a*).

The transfer electric current that flows in the direction of the photosensitive body in the transfer process for the front side of the first sheet of paper is roughly constant, as shown by the solid line in FIG. 4(*b*). Thus, the surface electric potential of the photosensitive body 31*b* after the transfer process for the front side of the first sheet of paper is performed (immediately before performing printing of the back side of the first sheet of paper) is roughly constant for the entire photosensitive body 31*b*, as shown by the solid line in FIG. 4(*c*).

Next, the recording paper that has been printed on its front side is switched back, and printing is performed for the back side (back side of the first page of recording paper) of the recording paper. In the transfer process when performing this printing, the transfer position of the recording paper is moved such that it passes the maximum paper passage position (B) shown in FIG. 4(*a*). This movement of the transport position is performed using the shifter structure 7A that is provided in the discharge unit 7A of the compound machine 1.

At this point, because the constant current control is performed in the transfer process for the back side of the first sheet of recording paper, for paper whose front side resistance value has risen because the paper passed through a fixing process when printing the front side, it is more difficult for transfer current to flow in comparison to when performing the transfer process for the front side of the first sheet of paper. Voltage thus increases, but in contrast to the region in which the recording paper is placed (hereinafter, paper placement region), there is no increase in the resistance value outside of the paper placement region, electrical current can easily flow, and therefore it is easy for a large amount of electric current to flow on the photosensitive body 31*b*, as shown by the broken line in FIG. 4(*b*).

However, by shifting the paper passage position from the (A) position to the (B) position shown in FIG. 4(*a*), there is a great effect on the electrical potential of the photosensitive body in an edge region where the region in which the recording is not placed is small (hereinafter, first edge region), due to the current flowing to the photosensitive body 31*b* concentrating in a local area (in FIG. 4(*b*), X1).

On the other hand, by the paper passage position shifting, in an edge region where the region in which the recording is not placed is large (hereinafter, second edge region), the electrical current that flows to the photosensitive body 31*b* does not concentrate locally because it is dispersed across a wide range, and the effect on the electrical potential of the photosensitive body becomes small (in FIG. 4(*b*), X2).

Thus, as shown in FIG. 4 (*c*), the surface electric potential of the photosensitive body 31*b* after performing the transfer process for the back side of the first sheet of paper (immediately before performing transfer to the front side of the second sheet of paper) decreases in the edge region of the photosensitive body 31*b* (y1, y2). This decrease in the electric potential value is larger in the first edge region (voltage y1) than in the second edge region (voltage y2). Among these, the decrease in the electric potential value in the first edge region may damage the photosensitive body, causing photographic fog on the photosensitive body 31*b*. On the other hand, little photographic fog is generated on the photosensitive body 31*b* in the second edge region, where the decrease in the electric potential value is relatively small, and because there is virtually no problem with defective prints due to fog, no damage to the photosensitive body.

Next, the first sheet of recording paper that has been printed on both sides is discharged, and printing is performed on the front side of the second sheet of recording paper. In the transfer process when performing this printing, same as in the transfer process for the front side of the first sheet of recording paper, the recording paper is transported such that it passes the maximum paper passage position (A) shown in FIG. 4(*a*). As described above, because there is little photographic fog on the photosensitive body 31*b* generated in the second edge region, even if part of the recording paper makes contact with the second edge region of the photosensitive body 31*b* and the transfer roller 31*d*, there is virtually no problem with the toner affixing to the recording paper due to fog.

Also, even if a slight amount of positional displacement occurs in the maximum paper passage position (A) of the second sheet of recording paper, because part of the recording paper does not make contact in the first edge region of the photosensitive body 31*b* and the transfer roller 31*d*, in which photographic fog is easily generated (does not make contact in the first edge region as long as the transport position is not greatly shifted), fogged portions on the photosensitive body 31*b* are not transferred onto the recording paper due to positional displacement of the recording paper, and defective prints are not generated. Thus, it is possible to reduce defective printing due to fog, which has been a problem in the conventional technology.

Further, in the transfer process of the front side of the second sheet of recording paper, because the recording paper passes between the photosensitive body 31*b* and the transfer roller 31*d*, the photosensitive body 31*b* and the transfer roller 31*d* are de-electrified after the transfer process of the front side of the second sheet of recording paper. As a result, the surface electric potential of the entire photosensitive body 31*b* is roughly constant, as shown by the solid line in FIG. 4(*c*). Consequently, defective printing due to fog does not occur in the transfer process of the back side of the second sheet of recording paper. Further, even when printing the third and subsequent sheets of recording paper, it is possible to reduce defective printing due to fog by changing the transfer position of the recording paper as described above.

Other Embodiments

In the embodiments described above, the present invention was described with respect to its application in a compound machine that includes a scanner function, printer function, and copy function. The present invention is not restricted to this, and can also be applied in an image forming apparatus provided with at least one of these functions, or in another image forming machine.

In the above manner, in the present invention, for an image forming apparatus provided with a duplex printing function, by changing the position that paper passes when printing a front side and the position that paper passes when printing a back side with a switching means (shifter function), the region in which the surface potential of the image carrier increases can be made small, shrinking the region that generates photographic fog. Thus, when recording on the second sheet or later of the recording medium, even if a small shift occurs in the transport position of that recording medium, it is possible to suppress contact made by the recording medium in the region that photographic fog was generated, defective printing that occurs due to fog on the recording medium can be prevented, and an improvement of image quality can be achieved.

The present invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes that come within the meaning and range of equivalency of the claims are intended to be embraced therein.

This application claims priority on Patent Application No. 2003-107939 filed in Japan on Apr. 11, 2003, the entire contents of which are hereby incorporated by reference.

INDUSTRIAL APPLICABILITY

The present invention is applicable to image forming apparatuses that can form an image; these are not limited to copy machines, printer and facsimile apparatuses, and the like.

The invention claimed is:

1. An image forming apparatus that has a duplex printing function, wherein while transporting a recording medium, after recording an image formed on an image carrier to a first side of the recording medium, this recording medium is re-transported towards the image carrier and an image formed on the image carrier is recorded on a second side of this recording medium that differs from the first side, the image forming apparatus comprising:

a switching means for switching the transport position of the recording medium when recording the image on the recording medium, such that it differs in the direction perpendicular to the recording medium transport direction when recording the image on the first side and when recording the image on the second side, a discharge portion for discharging the recording medium on which the image has been printed;

wherein the switching means has an offset function, provided in this discharge portion, that varies the discharge position of the recording medium that is discharged; and wherein the transfer position of the recording medium when recording an image on the recording medium is switched by the offset function of the switching means.

2. The image forming apparatus according to claim 1, wherein the transport position of the recording medium when recording the image on either the first side or the second side of the recording medium is set to a paper passage standard position of the recording medium on the image camer.

3. The image forming apparatus according to claim 1, wherein the image forming apparatus comprises an optical unit that writes image information on the image carrier; and when writing image information on the image carrier, the optical unit separately sets an image information writing point for recording the image to the first side of the recording medium, and an image information writing point for recording the image to the second side of the recording medium.

4. The image forming apparatus according to claim 3, wherein the optical unit comprises a writing timing detection sensor that sets the timing for writing image information onto the image carrier; and wherein the writing points are set by changing the writing timing from the writing timing detection sensor.

5. The image forming apparatus according to claim 1, wherein the transfer position of the recording medium is set to a region in which it is possible to operate a plurality of transfer rollers disposed in the transfer path of the recording medium, the image carrier, a fixing mechanism, a transfer mechanism, and, a developing mechanism disposed in the vicinity of the image carrier, various charging mechanisms, and a cleaning mechanism.

6. The image forming apparatus according to claim 1, wherein the transfer position of the recording medium is switched such that it differs when recording an image to the first side and when recording an image to the second side, and satisfies the relational expression.

(Distance of change in the transport position)<[(width of the image carrier)−(maximum width of the recording medium used for printing)]/2.

7. The image forming apparatus according to claim 2, wherein the image forming apparatus comprises an optical unit that writes image information on the image carrier; and when writing image information on the image carrier, the optical unit separately sets an image information writing point for recording the image to the first side of the recording medium, and an image information writing point for recording the image to the second side of the recording medium.

8. The image forming apparatus according to claim 2, wherein the transfer position of the recording medium is set to a region in which it is possible to operate a plurality of transfer rollers disposed in the transfer path of the recording medium, the image carrier, a fixing mechanism, a transfer mechanism, and, a developing mechanism disposed in the vicinity of the image carrier, various charging mechanisms, and a cleaning mechanism.

9. The image forming apparatus according to claim 3, wherein the transfer position of the recording medium is set to a region in which it is possible to operate a plurality of transfer rollers disposed in the transfer path of the recording medium, the image carrier, a fixing mechanism, a transfer mechanism, and, a developing mechanism disposed in the vicinity of the image carrier, various charging mechanisms, and a cleaning mechanism.

10. The image forming apparatus according to claim 4, wherein the transfer position of the recording medium is set to a region in which it is possible to operate a plurality of transfer rollers disposed in the transfer path of the recording medium, the image carrier, a fixing mechanism, a transfer mechanism, and, a developing mechanism disposed in the vicinity of the image carrier, various charging mechanisms, and a cleaning mechanism.

11. The image forming apparatus according to claim 2, wherein the transfer position of the recording medium is switched such that it differs when recording an image to the first side and when recording an image to the second side, and satisfies the relational expression (Distance of change in the transport position)<[(width of the image carrier)−(maximum width of the recording medium used for printing)]/2.

12. The image forming apparatus according to claim 3, wherein the transfer position of the recording medium is switched such that it differs when recording an image to the first side and when recording an image to the second side, and satisfies the relational expression (Distance of change in the transport position)<[(width of the image carrier)−(maximum width of the recording medium used for printing)]/2.

13. The image forming apparatus according to claim 4, wherein the transfer position of the recording medium is switched such that it differs when recording an image to the first side and when recording an image to the second side, and satisfies the relational expression (Distance of change in the transport position)<[(width of the image carrier)−(maximum width of the recording medium used for printing)]/2.

14. The image forming apparatus according to claim 5, wherein the transfer position of the recording medium is switched such that it differs when recording an image to the first side and when recording an image to the second side, and satisfies the relational expression.

* * * * *